US008668284B2

(12) United States Patent
Hauer

(10) Patent No.: US 8,668,284 B2
(45) Date of Patent: Mar. 11, 2014

(54) EJECTOR FOR EJECTING A MOVABLE FURNITURE PART

(71) Applicant: Julius Blum GmbH, Hochst (AT)

(72) Inventor: Christian Hauer, Horbranz (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/653,653

(22) Filed: Oct. 17, 2012

(65) Prior Publication Data

US 2013/0038189 A1 Feb. 14, 2013

Related U.S. Application Data

(63) Continuation of application No. PCT/AT2011/000139, filed on Mar. 18, 2011.

(30) Foreign Application Priority Data

Apr. 19, 2010 (AT) ..... A 630/2010

(51) Int. Cl.
*A47B 95/02* (2006.01)

(52) U.S. Cl.
USPC ..... 312/319.5; 312/310

(58) Field of Classification Search
USPC ..... 312/333, 330.1, 334.1, 310, 319.1, 237, 312/319.5–319.8
See application file for complete search history.

(56) References Cited

U.S. PATENT DOCUMENTS

| | | | | |
|---|---|---|---|---|
| 6,669,250 | B1 * | 12/2003 | St. Louis | 292/341.11 |
| 7,207,087 | B2 * | 4/2007 | Salice | 16/374 |
| 8,029,078 | B2 * | 10/2011 | Gasser | 312/319.5 |
| 8,056,992 | B2 * | 11/2011 | Gassner | 312/319.7 |
| 8,220,883 | B2 * | 7/2012 | Gasser et al. | 312/333 |
| 8,303,054 | B2 * | 11/2012 | Mattle | 312/319.5 |
| 8,317,276 | B2 * | 11/2012 | Huber et al. | 312/319.5 |
| 8,360,537 | B2 * | 1/2013 | Gasser | 312/319.5 |
| 2005/0091928 | A1 * | 5/2005 | Okulov et al. | 49/341 |
| 2007/0145867 | A1 * | 6/2007 | Gasser | 312/223.6 |
| 2008/0048538 | A1 * | 2/2008 | Karg | 312/319.2 |
| 2009/0284114 | A1 * | 11/2009 | Fitz | 312/319.5 |
| 2010/0037715 | A1 * | 2/2010 | Gasser | 74/27 |

FOREIGN PATENT DOCUMENTS

| | | |
|---|---|---|
| DE | 20 2006 011 039 | 12/2007 |
| WO | 2008/006616 | 1/2008 |
| WO | 2008/092176 | 8/2008 |
| WO | 2010/015513 | 2/2010 |

OTHER PUBLICATIONS

Machine translation of WO 2008/092176.*
International Search Report issued Jul. 13, 2011 in International (PCT) Application No. PCT/AT2011/000139.
Austrian Patent Office Search Report completed Jan. 13, 2011 in Austrian Patent Application No. A 630/2010.

* cited by examiner

*Primary Examiner* — Daniel Rohrhoff
(74) *Attorney, Agent, or Firm* — Wenderoth, Lind & Ponack, L.L.P.

(57) ABSTRACT

An ejector for ejecting a movable furniture part from a closed end position in or on a furniture body includes an ejection lever that can be driven by an electrical drive unit, in particular an electric motor. The ejection lever has a first ejection lever part and a second ejection lever part that can be moved relative to the first ejection lever part. An adjusting device causes the length of the ejection lever to change during the ejection process as a result of the two ejection lever parts sliding relative to each other.

20 Claims, 11 Drawing Sheets

EJECTOR FOR EJECTING A MOVABLE FURNITURE PART

BACKGROUND OF THE INVENTION

The invention concerns an ejector for ejecting a movable furniture part from a closed end position in or on a furniture carcass comprising an ejection lever drivable by an electric drive unit—in particular an electric motor. The ejection lever has a first ejection lever portion and a second ejection lever portion movable relative thereto.

The invention further concerns an article of furniture comprising a furniture carcass and a movably mounted furniture part and an ejector for ejecting the movable furniture part.

Such ejectors are already known from the state of the art. Primarily, either drawers or also flaps of an article of furniture are ejected with such ejectors, and that affords an article of furniture which is more operator-friendly.

Thus, for example, WO 2008/092176 A1 of Dec. 12, 2007 discloses an ejection lever for an ejector for ejecting a movable furniture part from a closed end position in or on a furniture carcass, comprising an elongate lever body, wherein the lever body is adapted to be variable in length.

In addition, WO 2010/015513 A1 of Jul. 22, 2009 discloses an ejection device which can be fitted into a furniture carcass and which comprises an ejection lever which has a contact surface and which is mounted in a carrier portion in such a way that it can be pivoted out of a non-use position into a use position. In its longitudinal extent, the ejection device includes a lever arm connected to a rotary mounting and an extension limb connected to the lever arm. The extension limb is pivotably mounted to the lever arm in such a way that it can be folded in, in the direction of outward pivotal movement of the ejection lever.

In addition, DE 20 2006 011039 U1 of Dec. 6, 2007 shows an ejection lever which is adapted to be adjustable in its length, in particular for adjusting the distance of the first furniture part, over which the first furniture part is movable, being driven with the pivotal movement of the ejection lever.

SUMMARY OF THE INVENTION

The object of the invention is to provide an improved ejector for ejecting a movable furniture part.

On the ejector according to the invention, the object is attained by the features of an ejection lever which is varied in its length with the opening movement. Therefore, the ejection process can be influenced in respect of the ejection travel and the torque to be transmitted.

For various situations of use where hitherto different ejection levers had to be produced (shorter or longer), that result can now be attained with a single variable-length ejection lever. That, in total, leads to lower manufacturing costs.

The fact that the two ejection lever portions are displaced relative to each other to change the length of the ejection lever during the ejection process provides that bending of the ejection lever can be avoided. Thus, this configuration involves bending-free movement, which can lead to a more stable ejection lever.

It has proven to be particularly advantageous if the ejection lever increases its length during the ejection process. An ejection lever which 'grows with' the opening movement makes it possible to achieve an improved ejection process as the ejection lever becomes progressively longer. This ensures that the ejection lever is connected to the movable furniture part for a longer time and over a longer ejection travel, and this therefore leads to a preferred ejection process.

In the retracted condition, such an ejection lever takes up a small amount of space, and it has a good torque characteristic when starting its movement as the lever spacing is smaller at the beginning.

Even in the case of narrow furniture carcasses, the ejection lever can be used because it requires a small amount of space and an ejection lever which is variable in length in that way can be integrated into an ejector more easily than would be allowed by a large ejection lever.

It has further proven to be advantageous if the ejection lever reduces its length during the ejection process. An ejection lever which is reduced in its length during the ejection process also makes it possible to preferably influence the torque to be transmitted.

It has proven to be particularly advantageous if the adjusting device has a completely mechanical configuration and/or has a lever mechanism and/or a transmission as a purely mechanical design for the adjusting device can be inexpensively manufactured and/or it is possible to achieve a change in the length of the ejection lever by way of a lever mechanism and/or a transmission in a simple mechanical fashion.

In a preferred embodiment, the adjusting device can be located at least partially—preferably substantially completely—in the interior of the ejection lever. The adjusting device can be located substantially completely in the interior of the ejection lever specifically by the design configuration involving a transmission, and that can lead to small structural sizes and thus a compact ejector.

In a preferred embodiment, the ejection lever can have at least a first ejection lever portion and a second ejection lever portion. The second ejection lever portion is adapted to be movable relative to the first ejection lever portion—preferably substantially linearly.

In addition, the adjusting device can be located at least partially on the ejection lever and/or is arranged at least on the—preferably substantially linearly—movable second ejection lever portion of the ejection lever.

It has been found to be particularly advantageous if the lever mechanism has at least one—preferably two—levers. During the ejection process, the lever moves the movable second ejection lever portion substantially linearly relative to the first ejection lever portion.

Particularly preferably, the movable second ejection lever portion can bear loosely against the first ejection lever portion which is not moved by the lever mechanism of the ejection lever—preferably in the retracted condition, during the displacement and in the extended condition. Thus at any time the pivotal movement of the ejection lever can guarantee that the second ejection lever portion can move away from the first ejection lever portion.

In that respect, it has proven to be particularly advantageous if the lever is provided on the movable second ejection lever portion of the ejection lever and on a part which is unmoved by the drive unit of the ejector. The provision of the lever on the movable second ejection lever portion and on an unmoved part of the ejector provides that the second ejection lever portion is automatically moved away from the first ejection lever portion by the pivotal movement of the ejection lever.

In a preferred embodiment, the linearly moved second ejection lever portion of the ejection lever can be guided by the first ejection lever portion of the ejection lever, that is driven by the drive unit. The fact that the second ejection lever portion is guided by the first ejection lever portion means that a permanently constant uniform movement can be achieved.

It has further proven to be advantageous if the ejection lever is adapted to be telescopic. Specifically, a design in the form of a telescopic ejection lever can lead to an ejection lever which is both compact and also robust and which is thus also long-lived, movable and variable in length.

Specifically, an article of furniture can include a furniture carcass and a movably mounted furniture part and an ejector for ejecting the movable furniture part as set forth herein.

BRIEF DESCRIPTION OF THE DRAWINGS

Further details and advantages of the present invention will be described more fully hereinafter by means of the specific description with reference to the embodiments illustrated in the drawings, in which.

DETAILED DESCRIPTION OF THE INVENTION

Figure 1A:
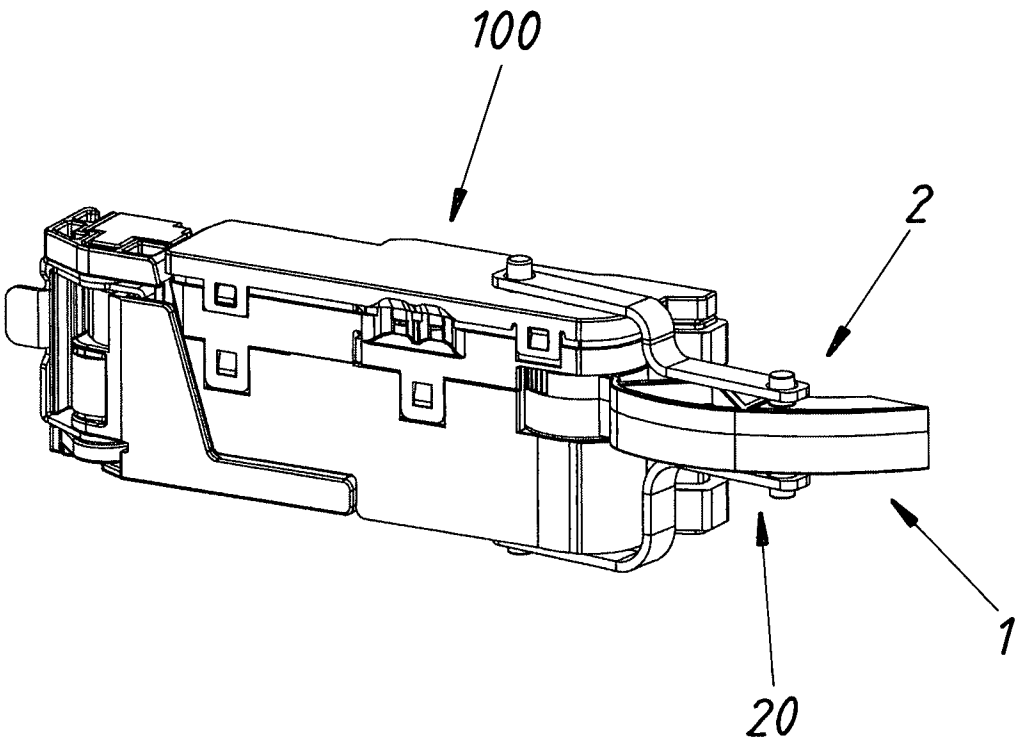
FIG. 1*a* shows a perspective view of an ejector having an adjusting device for changing the length of the ejection lever.

FIG. 1*a* shows a perspective view of an ejector 100 for ejecting a movable furniture part 102 (not shown) in a dosed end position in or on a furniture carcass 101 (not shown), the ejector 100 having a drive unit with which an ejection lever 1 can be driven. A lever mechanism 20 is arranged on the ejection lever 1. That lever mechanism 20 is part of the adjusting device 2 with which a change in length of the ejection lever 1 can be achieved.

Figure 1B:
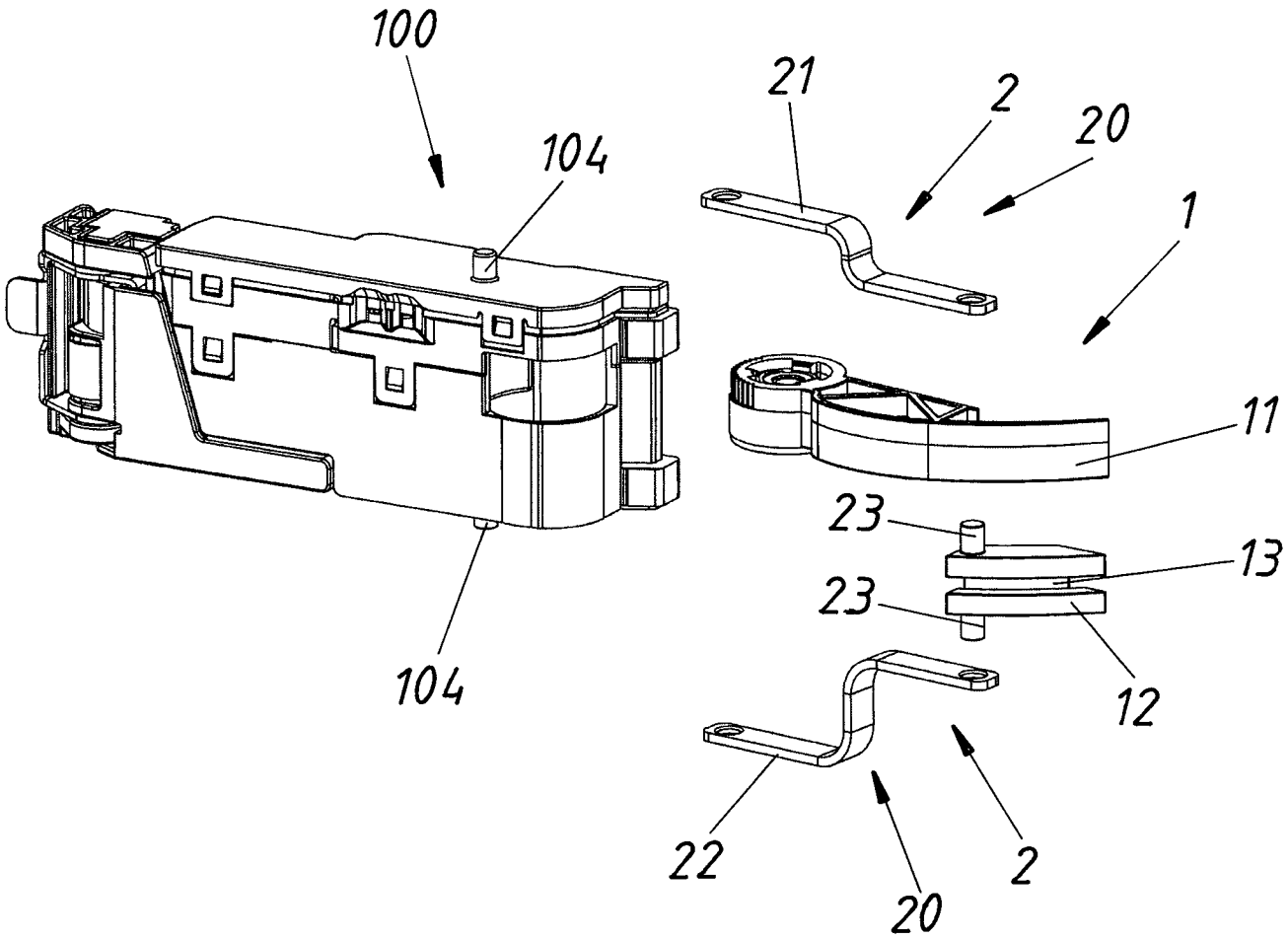
FIG. 1*b* shows an exploded view as in FIG. 1*a*, FIGS. 2*a* through 2*c* show three plan views in different pivotal positions of the ejection lever with variation in length.

FIG. 1*b* shows an exploded view of an ejector 100 as just described in FIG. 1*a*. Here, the ejection lever 1 has a first ejection lever portion 11 and a second ejection lever portion 12, wherein the second ejection lever portion 12 is arranged linearly movably relative to the first ejection lever portion 11. In this embodiment, the second ejection lever portion 12 has a guide groove 13 by means of which the linear mobility on the first ejection lever portion 11 can be achieved. The movement of the second ejection lever 12 is effected by way of the lever mechanism 20. In this case, the lever mechanism 20 has two levers 21 and 22 which are arranged on the one hand on the movable second ejection lever portion 12—more precisely at the pin 23 thereof—and which on the other hand are arranged movably at the unmoved parts (stationary) 104 of the ejector 100. During the outward pivotal movement of the ejection lever 1 by the drive unit, the second ejection lever portion 12 is extended by the lever mechanism 20 and thus provides that the ejection lever 1 increases its length during the ejection process.

Figure 2A:
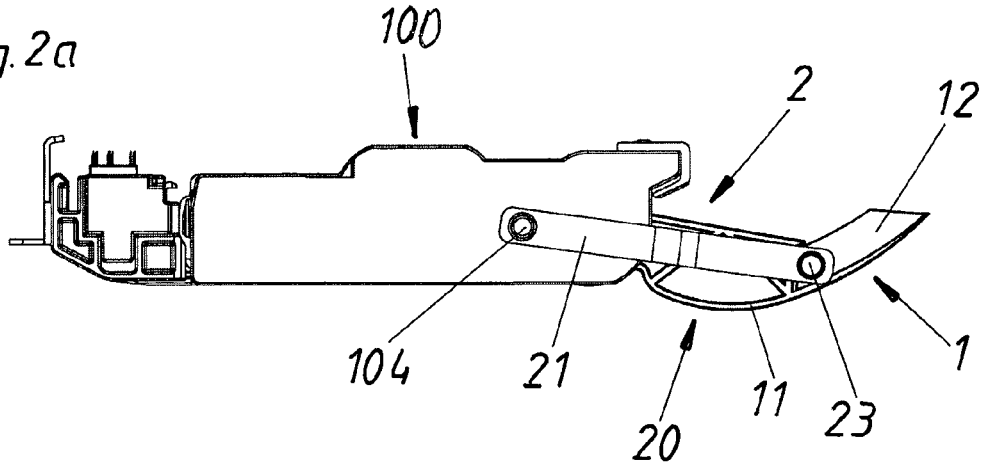
Figure 2B:
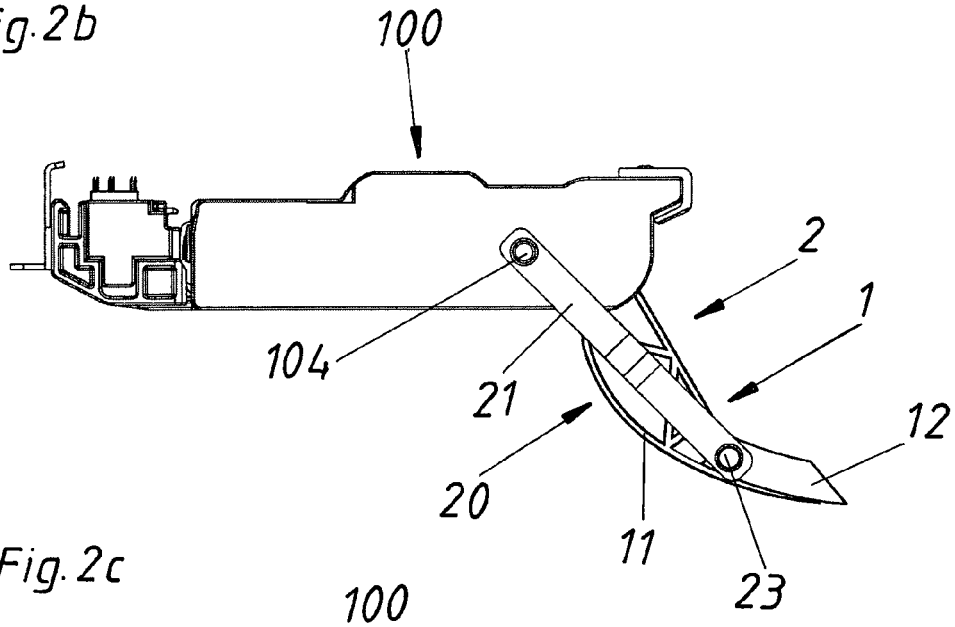
Figure 2C:
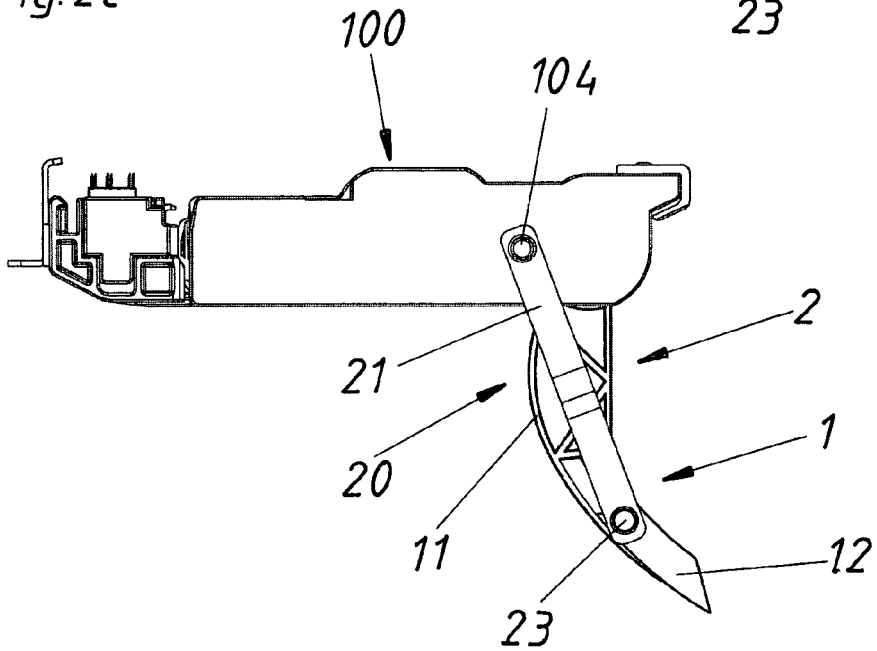

FIGS. 2*a* through 2*c* show plan views of various pivotal positions of an ejector 100 with a variable-length ejection lever 1 which, during the ejection process, changes its length by displacement of the two ejection lever portions 11 and 12 relative to each other.

FIG. 2*a* shows an inwardly pivoted ejection lever 1 of the ejector 100. In this case, the ejection lever 1 has a first ejection lever portion 11 and a second ejection lever portion 12 movable relative thereto. The lever mechanism 20 which is arranged on the one hand on a stationary part 104 of the ejector 100 and which on the other hand is arranged by way of the pin 23 on the second ejection lever portion 12 is part of the adjusting device 2.

In FIG. 2*b*, the ejection lever 1 is already partially pivoted out by the drive unit. The second ejection lever portion 12 of the ejection lever 1 was extended by the lever mechanism 20 of the adjusting device 2, which led to a change in length of the ejection lever 1 during the ejection process. That second ejection lever portion 12 was displaced by the lever 21 of the lever mechanism 20, which is arranged at the pin 23 of the second ejection lever portion 12 and the stationary part 104 of the ejector 100.

FIG. 2*c* shows a substantially completely extended ejection lever 1, in which the second ejection lever portion 12 has reached its substantially maximum distance away from the first ejection lever portion 11.

Figure 3A:
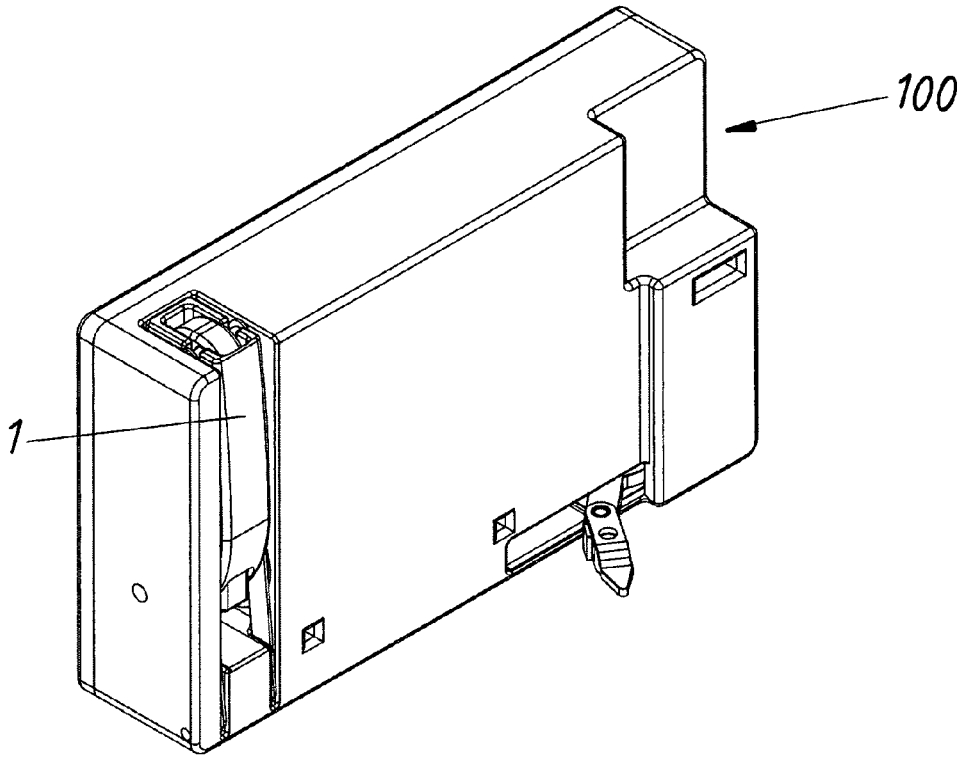
FIGS. 3*a* through 3*c* show various pivotal positions of a variant of a further ejector with an ejection lever which is variable in length.

FIG. 3*a* shows a perspective view of a variant of an ejector 100 having a drivable ejection lever 1, wherein the drivable ejection lever 1 is in its starting position at which no movement of a movable furniture part 102 (not shown) would yet occur.

Figure 3B:
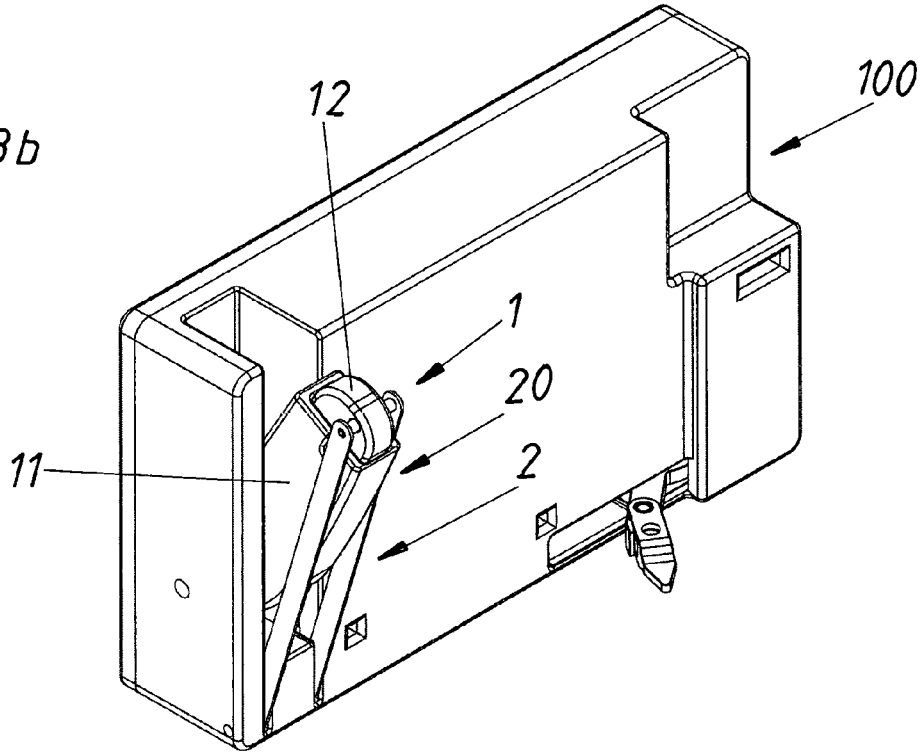

FIG. 3*b* shows a perspective view of an ejector 100 with a variable-length ejection lever 1, wherein pivotal movement of the ejection lever 1 by a drive has already taken place. The second ejection lever portion 12 of the ejection lever 1 is telescopically extended from the first ejection lever portion 11 of the ejection lever 1 by the adjusting device 2—Inter alia consisting of the lever mechanism 20.

Figure 3C:
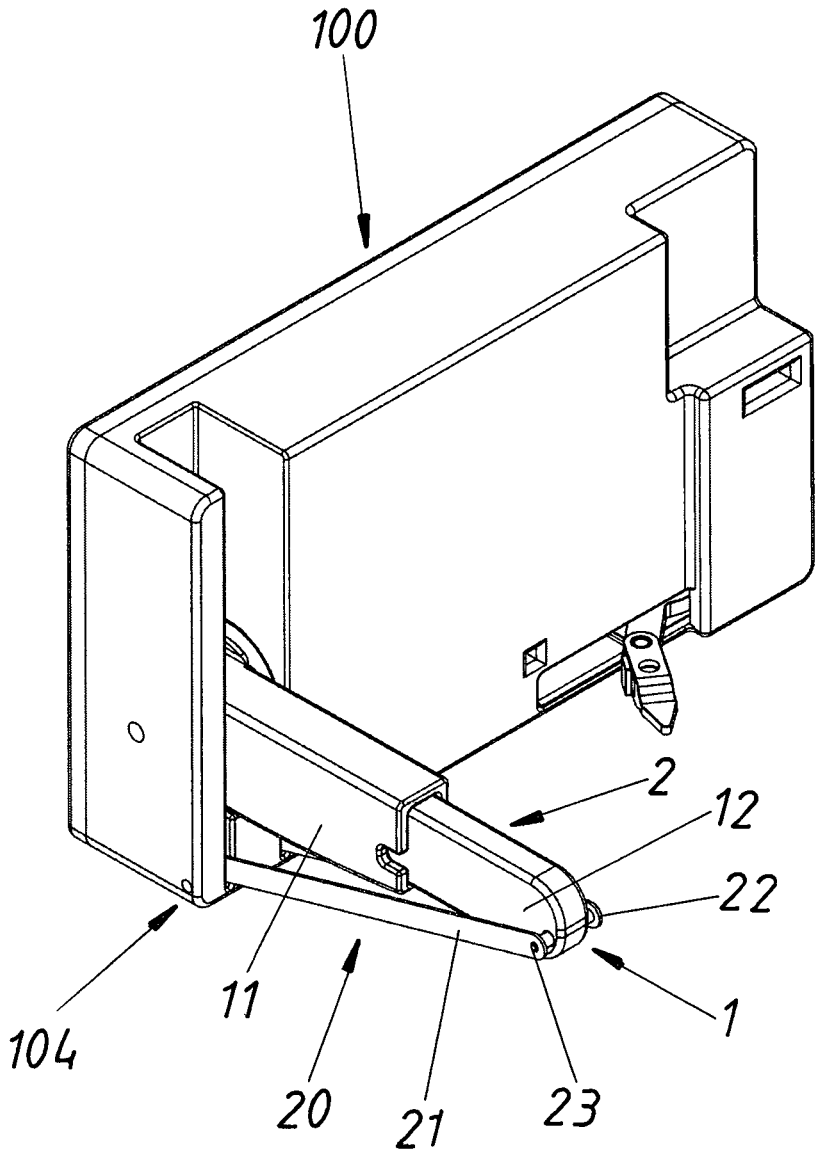

FIG. 3*c* shows the ejector 100 on which the ejection lever 1 has been substantially completely pivoted out by the drive unit. During the outward pivotal process, the ejection lever 1 has changed its length—more precisely increased it—by the second ejection lever portion 12 being telescopically extended out of the first ejection lever portion 11 by the adjusting device 2 or its lever mechanism 20. The lever mechanism 20—comprising the two levers 21 and 22—is pivotably mounted on the one hand to the second ejection lever portion 12 by way of the pin 23 and on the other hand to an unmoved part 104 of the ejector 100.

It will be appreciated that the adjusting device 2 or its lever mechanism 20 could also be of such a configuration that during the outward pivotal process, the ejection lever 1 does not increase its length but reduces it. For example, the length of ejection lever 1 can be reduced if it should be desired that the torque to be transmitted is lower at the beginning and is greater towards the end of the outward pivotal movement. In addition, it would also be possible to imagine designing an adjusting device 2 in such a way that the change in length of the ejection lever 1 takes place in differing relationship (that is to say, the line for example initially increases and later decreases again or vice-versa). Thus, it can be imagined without any doubt that the change in length of the ejection lever 1 can be altered in accordance with a profile that is to be predetermined.

Figure 3D:
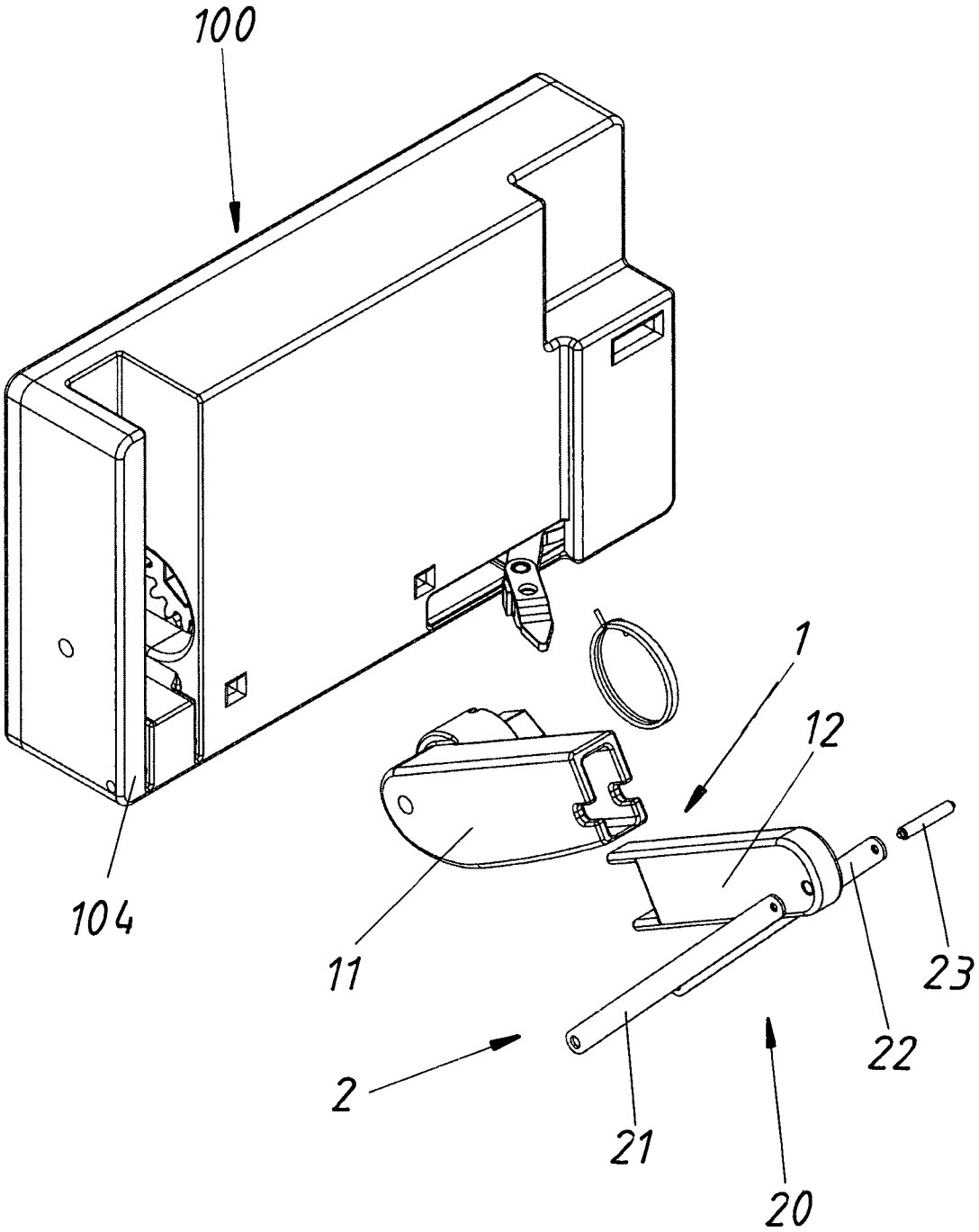
FIG. 3*d* shows an exploded perspective view of an ejector.

FIG. 3*d* shows the exploded view of the ejector 100 as just described in FIGS. 3*a* through 3*c*. Here, the parts of the ejection lever 1 comprise the second ejection lever portion 12 mounted telescopically in the first ejection lever portion 11. That second ejection lever portion 12 is in this case adjustable by the adjusting device 2. For that purpose, the adjusting device 2 has a lever mechanism 20 whose levers 21 and 22 are arranged hingedly on the second ejection lever portion 12 by way of a pin 23.

The second ejection lever portion 12 is guided by the first ejection lever portion 11. During the ejection process, the second ejection lever portion 12 bears against the first ejection lever portion 11 of the ejection lever 1 both in the retracted condition during the displacement and also in the extended condition.

Figure 4A:
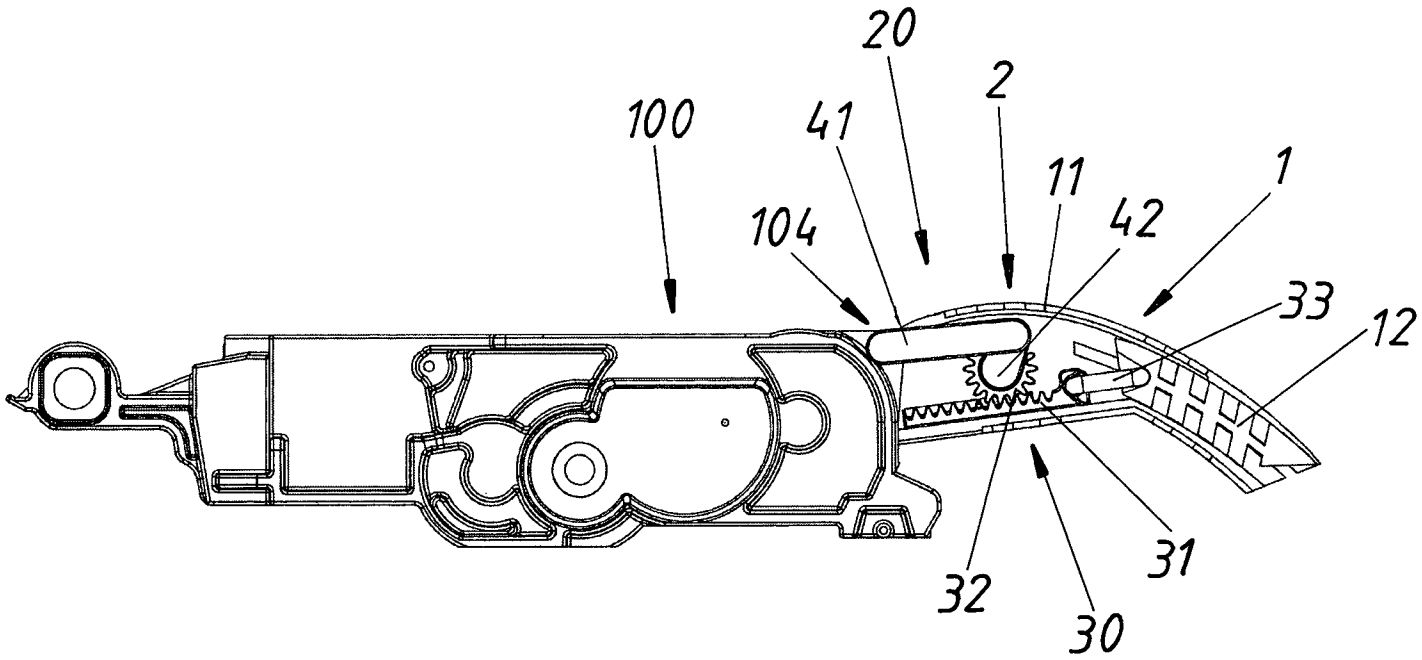
FIGS. 4*a* through 4*c* show plan views of various pivotal positions in a variant of an ejector with a variable-length ejection lever with transmission.
Figure 4B:
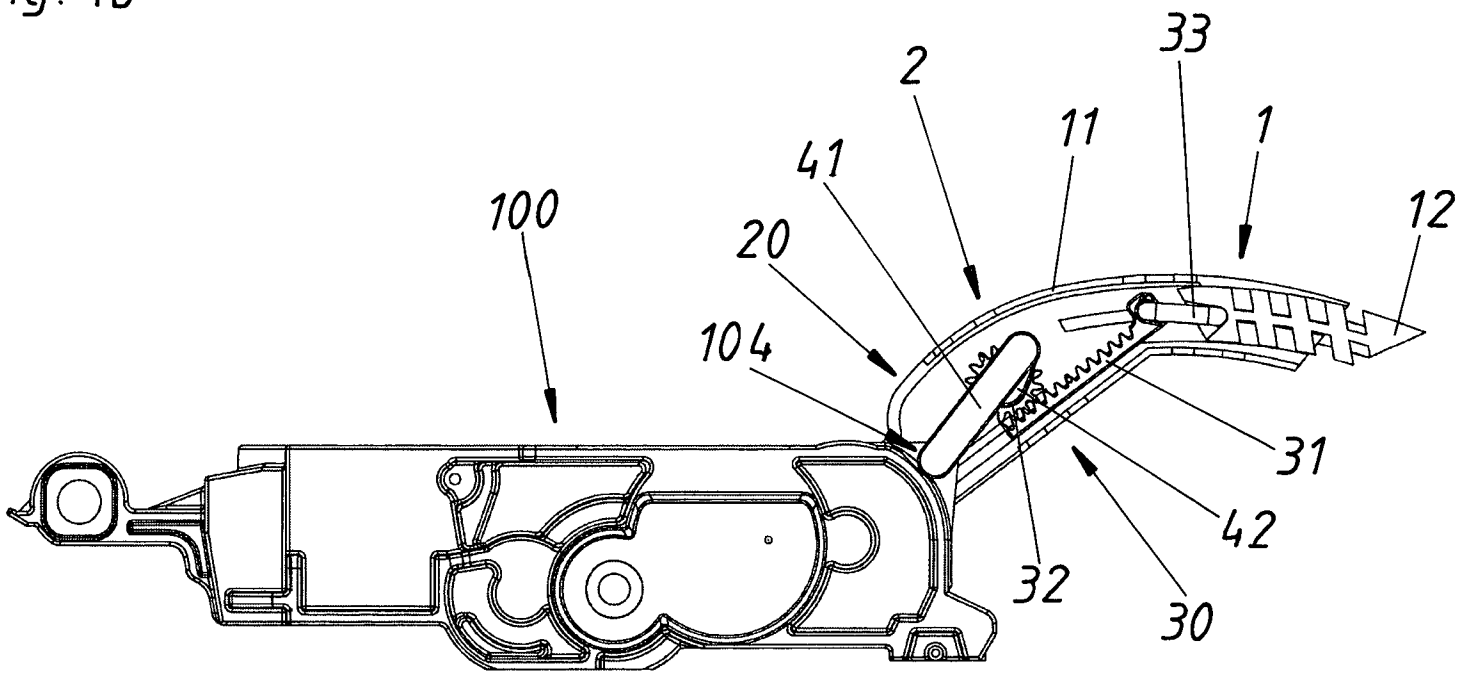
Figure 4C:
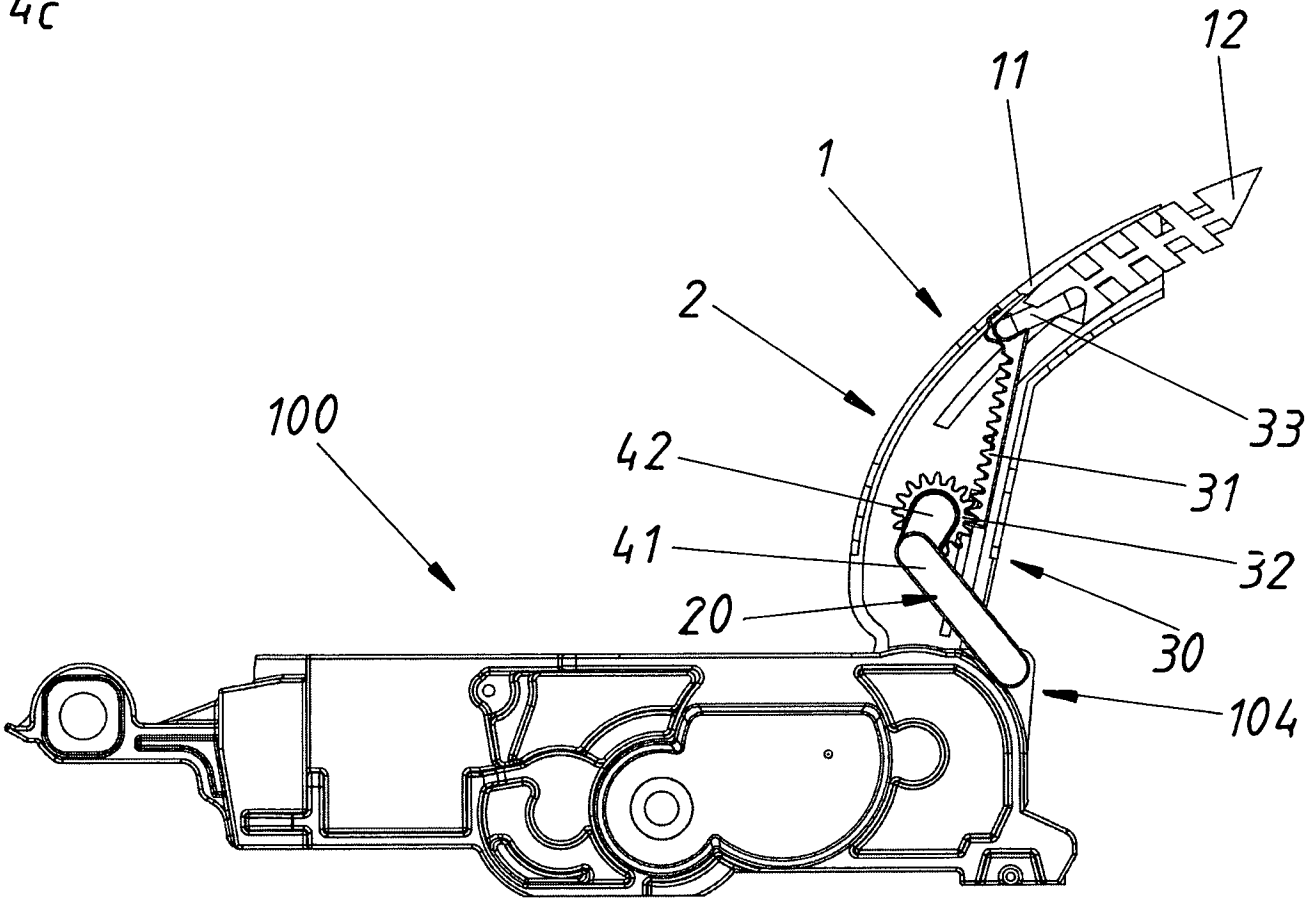

FIGS. 4*a* through 4*c* show a further variant of an ejector 100 comprising an ejection lever 1 which changes its length during the ejection process by displacement of the two ejection lever portions 11 and 12 relative to each other.

In that respect, the adjusting device 2 which causes that change in length of the ejection lever 1 is formed both with a lever mechanism 20 and also with a transmission 30.

In this specific embodiment, during the outward pivotal process, the length of the ejection lever 1 is not only increased or reduced, but at the beginning the ejection lever portion 12, during the pivotal process, moves inwardly as far as an angle of about 120 degrees of the ejection lever 1. The lever portion 12 only then moves outwardly—by virtue of the configuration of the lever mechanism 20 and the transmission 30 which interacts therewith—and thus increases the overall length of the ejection lever 1 until it reaches its maximum length when the ejection lever 1 is entirely extended.

Accordingly therefore, at the beginning—during the outward pivotal movement of the ejection lever 1—there is no change in the length of the ejection lever 1. It is only as from a predefined pivotal angle (in this embodiment at about 120°) that the ejection lever 1 changes its length by the displacement of the two ejection lever portions 11 and 12 relative to each other.

FIG. 4*a* shows a substantially inwardly pivoted ejection lever 1 of the ejector 100. In this embodiment, the adjusting device 2 comprises the lever mechanism 20 which has the levers 41 and 42 and the transmission 30 which has a rack 31, a gear 32 and an adjusting element 33. The ejection lever portion 12 is still disposed entirely in the interior of the ejection lever portion 11.

The transmission 30 is also disposed in the interior of the ejection lever 1, which contributes to a compact configuration for the ejector 100.

During the ejection process, the ejection lever portion 12 is now moved inwardly (not shown) as far as an angle of about 120° and only then—after continuation of the rotary movement of the ejection lever 1—the ejection lever portion 12 is pushed outwardly by the adjusting device 2 (by its lever mechanism 20 or its transmission 30) and thus causes an increase in the length of the ejection lever 1 (see FIG. 4*b*).

FIGS. 4*b* and 4*c* now show two different pivotal positions of the ejection lever 1 of the ejector 100. In this case, displacement of the two ejection lever portions 11 and 12 relative to each other was effected by way of the levers 41 and 42 of the lever mechanism 20, the lever 41 being arranged hingedly on an unmoved part 104 of the ejector 100. By virtue of the outward pivotal movement of the ejection lever 1, the rack 31 is displaced by the gear 32, by way of the lever mechanism 20 and the transmission 30, and the second ejection lever portion 12 is displaced relative to the first ejection lever portion 11 by way of the connecting element 33.

By virtue of the design configuration of the lever mechanism 20 and the transmission 30, it is possible for the length of the ejection lever 1 to be caused to change during the ejection process in accordance with criteria which are to be predetermined as desired.

A cover (not shown here) which is arranged on the ejection lever 1 serves as a guide for the gear 32 and the rack 31 and also as safety contact protection.

Figure 5:
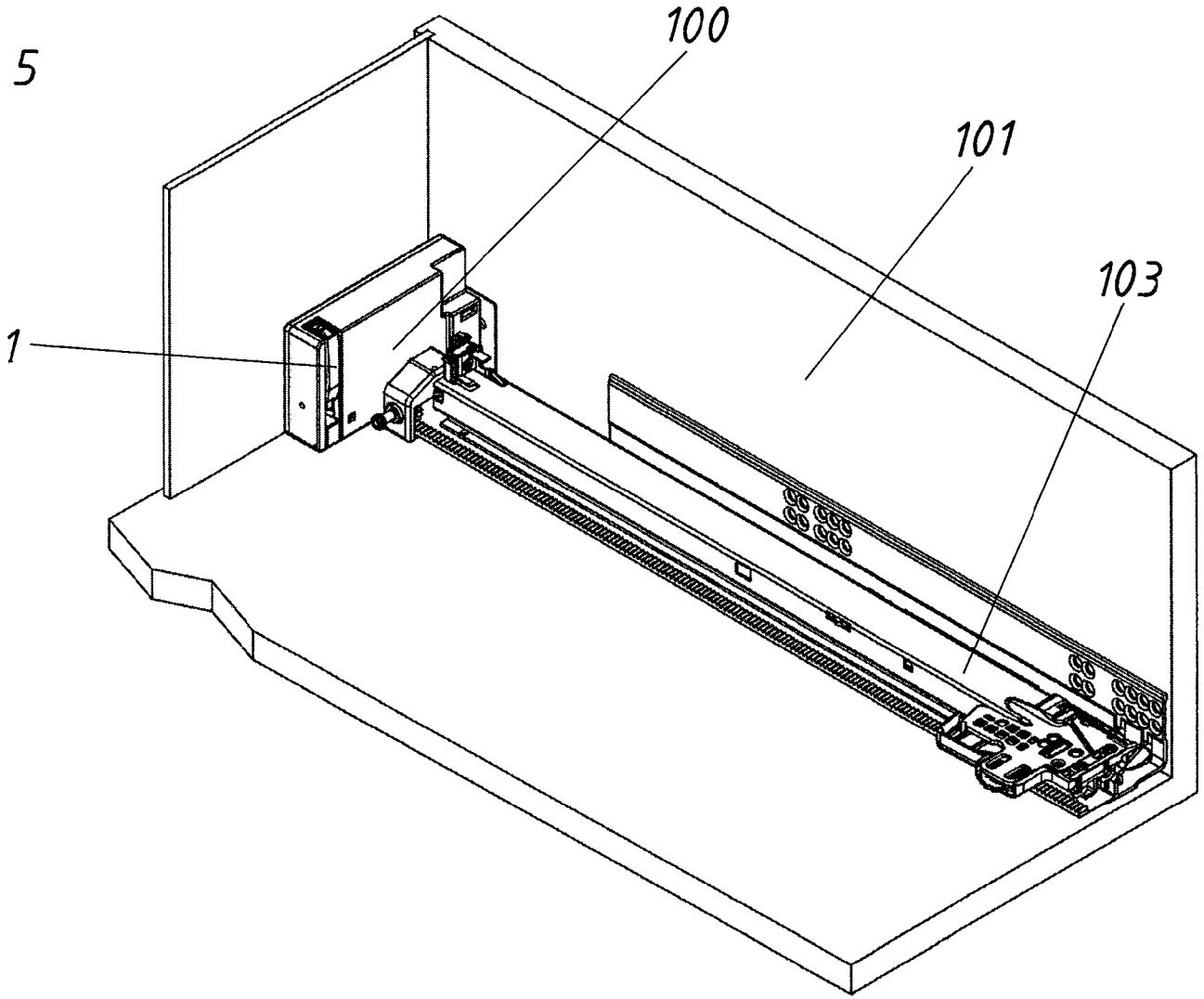
FIG. 5 shows a perspective view of a section through a furniture carcass with an ejector and an extension guide.

FIG. 5 shows a perspective view of a section through a furniture carcass 101 with an ejector 100 and an extension guide 103 on which a movable furniture part 102 (not shown) can be arranged. In this view, the ejection lever 1 of the ejector 100 is in its starting position in which there would not yet be any movement of a movable furniture part 102.

Figure 6:
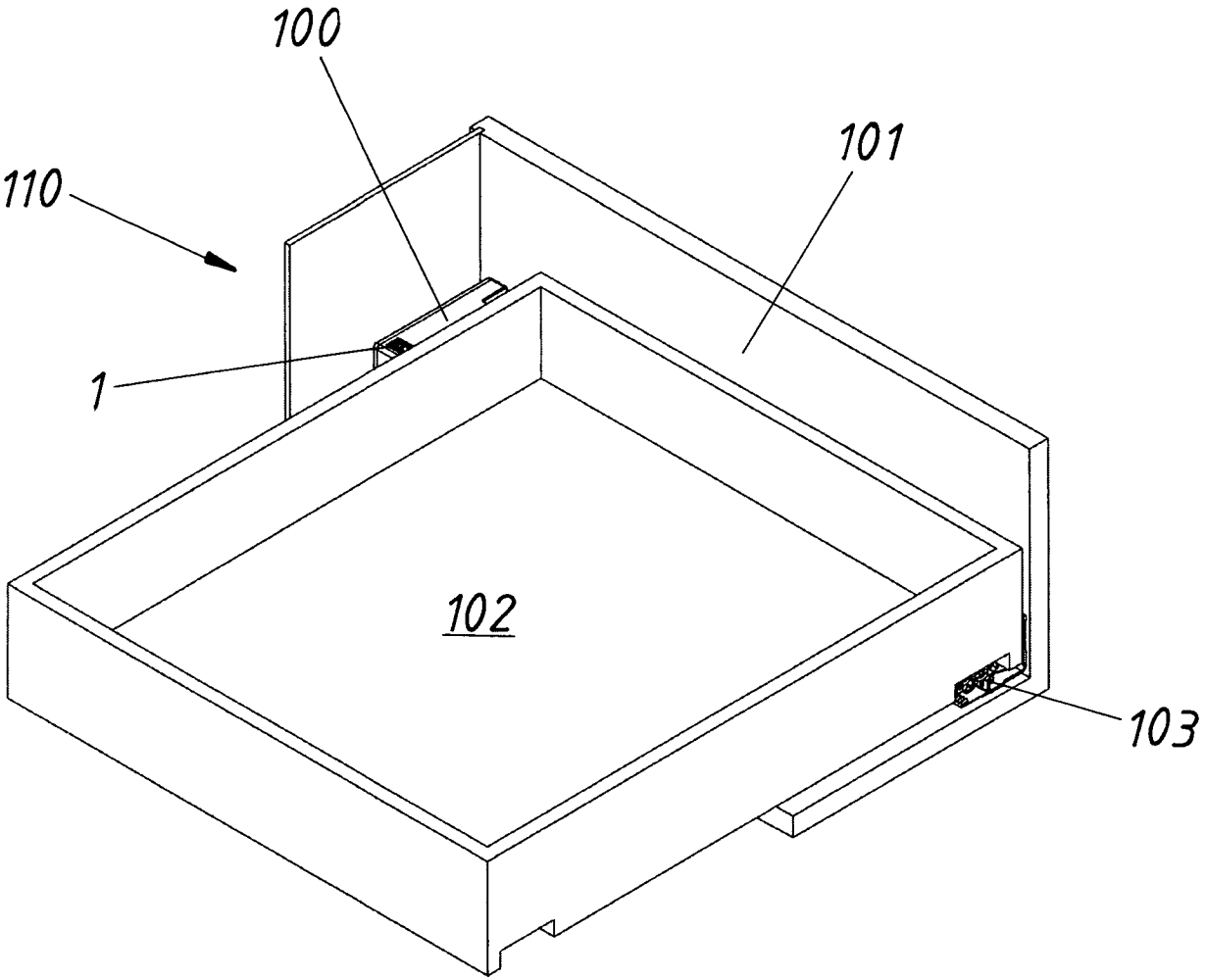
FIG. 6 shows a perspective view of a part of an article of furniture, furniture carcass, movable furniture part, ejector and extension guide.

FIG. 6 shows an article of furniture 110 with a furniture carcass 101 in which there is arranged an extension guide 103 on which a movable furniture part 102—in this case a drawer—is arranged. Disposed behind the movable furniture part 102 is the ejector 100 which can eject the drawer 102 by way of the variable-length ejection lever 1.

In this arrangement, the adjusting device 2 (not shown) provides that the length of the ejection lever 1 changes during the ejection process while the ejection lever 1 bears against the movably mounted furniture part 102.

Even if the invention has been specifically described by means of the illustrated embodiment, it will be self-evident that the subject-matter of the application is not limited to that embodiment but rather it is self-evident that measures and modifications which serve to implement the idea of the invention are certainly conceivable and desired.

The invention claimed is:

1. A device comprising:

an ejector for ejecting a movable furniture part from a closed end position in or on a furniture carcass, said ejector including:

an ejection lever having a first ejection lever portion and a second ejection lever portion movable relative to said first ejection lever portion; and an adjusting device for changing a length of said ejection lever during an ejection process by displacement of said first ejection lever portion and said second ejection lever portion relative to each other, said adjusting device having a lever mechanism having at least one lever configured to move said second ejection lever portion substantially linearly relative to said first ejection lever portion during the ejection process.

2. The device according to claim 1, further comprising an electric drive unit for driving said ejection lever, said electric drive unit being an electric motor.

3. The device according to claim 1, wherein said adjusting device is configured to reduce a length of said ejection lever during the ejection process.

4. The device according to claim 1, wherein at least a portion of said adjusting device is located in an interior of said ejection lever.

5. The device according to claim 1, wherein said adjusting device is located substantially completely in an interior of said ejection lever.

6. The device according to claim 1, wherein at least part of said adjusting device is located on said ejection lever.

7. The device according to claim 6, wherein said at least part of said adjusting device is at least partially arranged on said second ejection lever portion.

8. The device according to claim 1, wherein at least part of said adjusting device is at least partially arranged on said second ejection lever portion.

9. The device according to claim 1, wherein said at least one lever is two levers configured to move said second ejection lever portion substantially linearly relative to said first ejection lever portion during the ejection process.

10. The device according to claim 1, wherein said at least one lever is arranged so as to have a first section located on said second ejection lever portion, and so as to have a second section located on a stationary part of said ejector.

11. The device according to claim 1, wherein said first ejection lever portion is configured to guide said second ejection lever portion during the ejection process.

12. The device according to claim 1, wherein said ejection lever is telescopic.

13. An article of furniture comprising:

a furniture carcass;

a movably-mounted furniture part mounted to said furniture carcass; and said device of independent claim 1 for ejecting said movably-mounted furniture part.

14. A device comprising:

an ejector for ejecting a movable furniture part from a closed end position in or on a furniture carcass, said ejector including:

an ejection lever having a first ejection lever portion and a second ejection lever portion movable relative to said first ejection lever portion; and an adjusting device for changing a length of said ejection lever during an ejection process by displacement of said first ejection lever portion and said second ejection lever portion relative to each other, said adjusting device having a lever mechanism for moving said second ejection lever portion, said second ejection lever portion being configured to bear loosely against said first ejection lever portion which is not moved by said lever mechanism.

15. The device according to claim 14, wherein said movable second ejection lever portion is configured to bear loosely against said first ejection lever portion during displacement and in an extended condition.

16. The device according to claim 14, further comprising an electric drive unit for driving said ejection lever, said electric drive unit being an electric motor.

17. The device according to claim 14, wherein at least a portion of said adjusting device is located in an interior of said ejection lever.

18. The device according to claim 14, wherein at least part of said adjusting device is located on said ejection lever.

19. The device according to claim 14, wherein at least part of said adjusting device is at least partially arranged on said second ejection lever portion.

20. The device according to claim 14, wherein said first ejection lever portion is configured to guide said second ejection lever portion during the ejection process.

* * * * *